United States Patent [19]

Morvant

[11] Patent Number: 4,790,088

[45] Date of Patent: Dec. 13, 1988

[54] PERMANENT PHOTOGRAPHIC MEMORIAL MARKER

[75] Inventor: Artie J. Morvant, Thibodaux, La.

[73] Assignee: Artico, Inc., Thibodaux, La.

[21] Appl. No.: 64,705

[22] Filed: Jun. 22, 1987

[51] Int. Cl.[4] ..... G09F 19/00; E04H 13/00

[52] U.S. Cl. ..... 40/124.5; 40/160

[58] Field of Search ..... 40/124.5, 160

[56] References Cited

U.S. PATENT DOCUMENTS

| | | | |
|---|---|---|---|
| 148,245 | 3/1874 | Richardson | 40/124.5 |
| 269,429 | 12/1882 | Knight | 40/124.5 |
| 296,431 | 4/1884 | Miller | 40/124.5 |
| 359,639 | 3/1887 | Shelton | 40/124.5 |
| 373,243 | 11/1887 | Miller | 40/124.5 |
| 695,774 | 3/1902 | White | 40/124.5 |
| 822,106 | 5/1906 | Fancher | 40/124.5 |
| 953,053 | 3/1910 | McMullen | 40/124.5 |
| 1,624,048 | 4/1927 | Haggenjos | 40/124.5 |
| 1,737,474 | 11/1929 | Newhouse | 40/124.5 |
| 1,904,738 | 4/1933 | Johnson | 40/124.5 |
| 2,068,830 | 1/1937 | Warembourg | 40/124.5 |
| 2,312,859 | 3/1943 | Zentmyer | 40/124.5 |
| 3,045,374 | 7/1962 | Lucken et al. | 40/124.5 |
| 3,438,159 | 4/1969 | Bergener | 40/124.5 |
| 3,570,159 | 3/1971 | Bergener | 40/124.5 |
| 4,259,381 | 3/1981 | Narita | 40/124.5 |
| 4,285,149 | 8/1981 | Barryhill | 40/124.5 |

OTHER PUBLICATIONS

Dedo Monument Portraits Catalog No. 14, J. A. Dedouch Co., Oak Park, Ill.

*Primary Examiner*—Paul J. Hirsch

*Attorney, Agent, or Firm*—A. Robert Theibault

[57] ABSTRACT

The present disclosure is directed to a permanent grave marker employing a photograph laminated front and rear with a light stable abrasion resistant film secured in a molded picture frame having a flat back and a recessed opening complemental to the photograph. An aluminum plate complemental to the recessed opening in the back of said picture frame fused to the laminated photograph by a rubber-vinyl adhesive. There is means sealing the back of said picture frame and aluminum plate flush to the permanent grave marker with the picture exposed forwardly of the marker in place in the frame with a silicone rubber adhesive sealant. There is provided anchoring means for securing the frame and picture to the permanent grave marker flush with each other in a water repellant sealed condition.

1 Claim, 2 Drawing Sheets

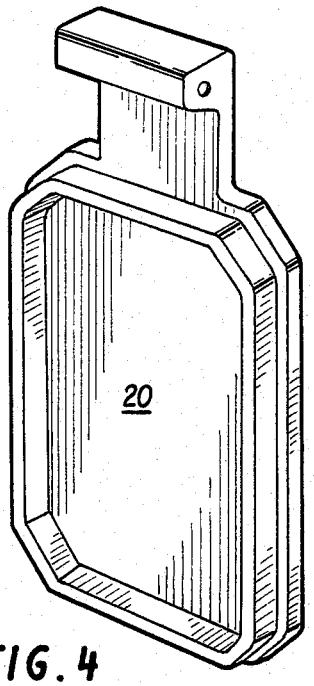
FIG. 4
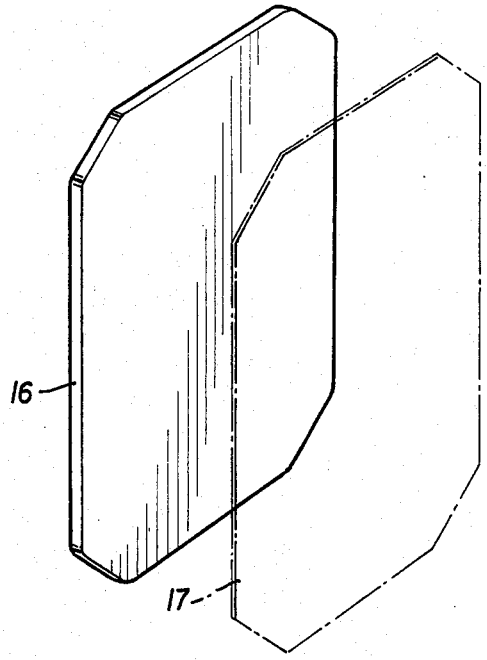
FIG. 5
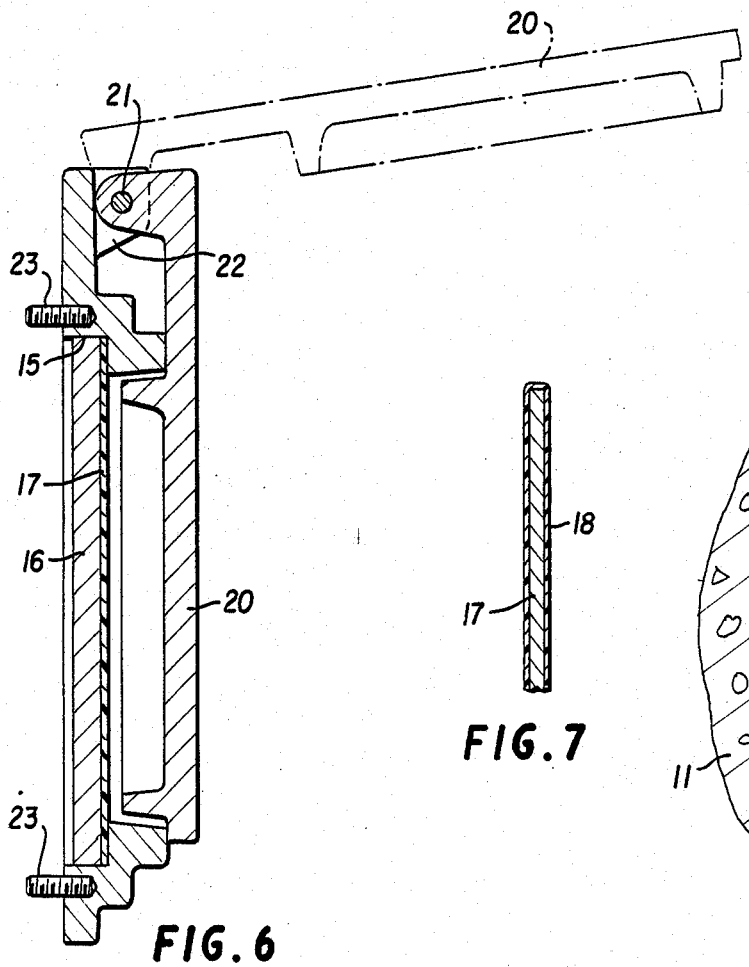
FIG. 6
FIG. 7
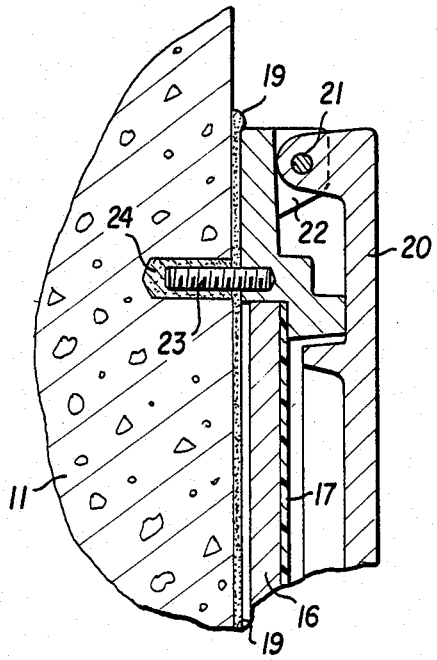
FIG. 8

PERMANENT PHOTOGRAPHIC MEMORIAL MARKER

TECHNICAL FIELD

My invention relates to affixing a photograph of a deceased in a picture frame secured to a permanent grave marker which is laminated with a protective film covering and is water tight sealed in a picture frame permanently attached to a permanent grave marker either of the tombstone type or crypt door or flush inground stone or placque marker.

BACKGROUND ART

Heretofore, many forms of photographic grave markers have been known. The closest art known to me prior to this application are as follows:

U.S. Pat. No. 148,245 of 1874
U.S. Pat. No. 269,429 of 1882
U.S. Pat. No. 296,431 of 1884
U.S. Pat. No. 359,639 of 1887
U.S. Pat. No. 373,243 of 1887
U.S. Pat. No. 695,774 of 1902
U.S. Pat. No. 822,106 of 1906
U.S. Pat. No. 953,053 of 1910
U.S. Pat. No. 1,737,474 of 1929
U.S. Pat. No. 2,068,830 of 1937
U.S. Pat. No. 2,312,859 of 1943
U.S. Pat. No. 3,438,159 of 1969
U.S. Pat. No. 3,570,159 of 1971
U.S. Pat. No. 4,259,381 of 1981
DEDO MONUMENT PORTRAITS CATALOG NO. 14
J. A. DEDOUCH CO. OAK PARK, ILL.

DISCLOSURE OF THE INVENTION

In accordance with my invention I provide a permanent grave marker whether of the tombstone type, crypt door, mausoleum or inground grass level memorial stones or bronze placques to which are secured picture frames of molded plastic or metal having insets for receiving a photograph of a deceased, which photograph has been laminated or coated with a light stable abrasion resistant transparent polyurethane film having high resistance to ultra-violet light of the type marketed by the Industrial Specialties Division of 3M of St Paul, Minn. under product designations Y-8671 and Y-8672, having thicknesses of (0.36 mm) and (0.20 mm) respectively.

The laminated photograph is fused to an aluminum plate by a rubber-vinyl adhesive 80 marketed by the Adhesives, Coatings and Sealers Division /3M of St Paul, Minn. under the designation of Rubber & Vinyl Adhesive 80 which contains a neoprene base.

The frame, aluminum plate and its attached laminated picture are sealed to the permanent grave marker by a silicone rubber adhesive sealant of the type manufactured by General Electric Co. under the designation of G.E. Silicone Rubber Caulk Rubber Adhesive Sealant Stock No. 112.

The mechanical joining of the picture frame to the permanent grave marker is effected by use of two metal screws or bolts which are threaded into the back of the picture frame and a fixed earth marker such as a tombstone or end wall of the crypt or memorial stone is drilled to receive the other ends of the screw or bolts which are cemented in place in the earth marker thus effecting a rigid permanently anchored picture and frame sealed to a permanent grave marker. The picture frame may be structured to provide a hinged gravity closing cover to shield the laminated picture from ultra-violet rays of the sun when not being viewed.

BRIEF DESCRIPTION OF THE FIGURES OF DRAWINGS

FIG. 4 is a perspective view of the lid cover from the rear thereof.

FIG. 5 is a perspective view of the aluminum plate employed with the frame of the present invention with the laminated photograph shown in chain lines.

FIG. 6 is a vertical sectional view of the assembly of FIG. 1 with the lid cover raised.

FIG. 7 is a fragmentary vertical sectional view taken through the laminated photograph employed with the present invention.

FIG. 8 is a fragmentary vertical sectional view of the present invention taken at an enlarged scale showing the frame and cover permanently mounted to the grave marker from the rear.

BEST MODE FOR CARRYING OUT THE INVENTION

Figure 1:
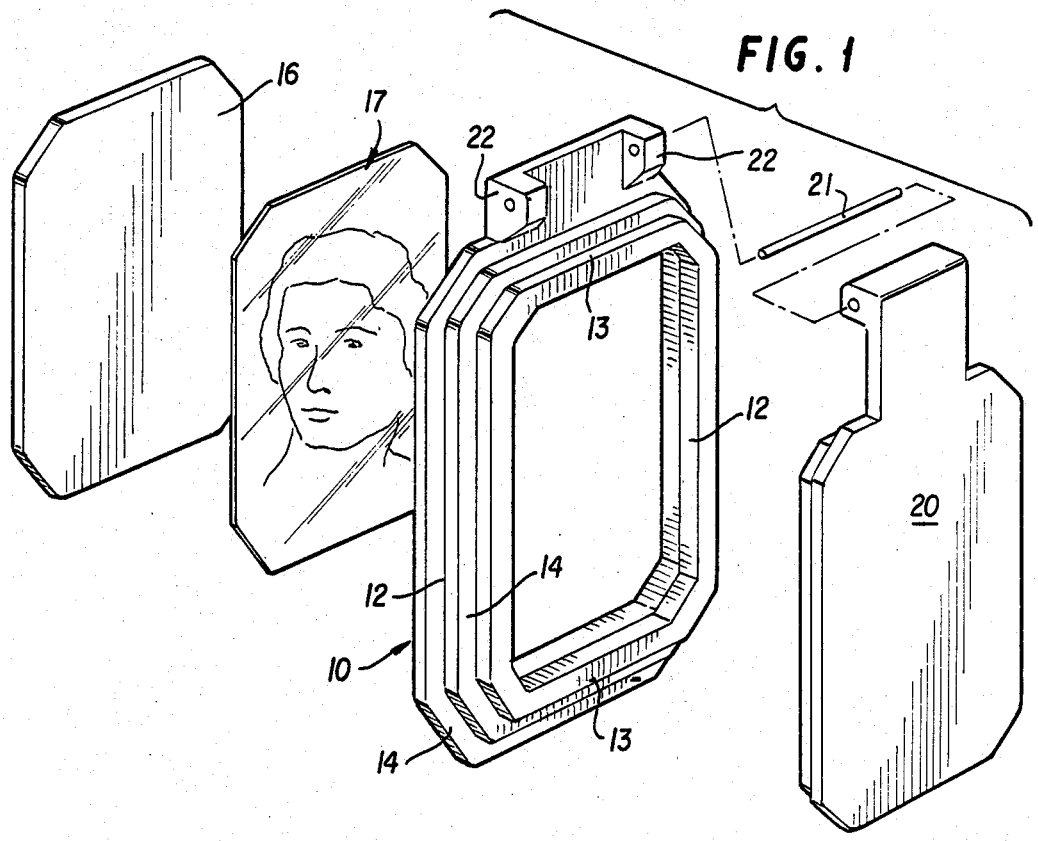
FIG. 1 is an exploded perspective view of the Permanent Photograph Memorial Marker of the present invention.
Figure 2:
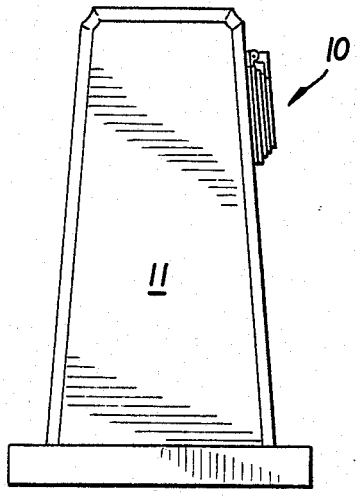
FIG. 2 is a side elevational view of a Tombstone having the marker of the present invention mounted permanently thereon.
Figure 3:
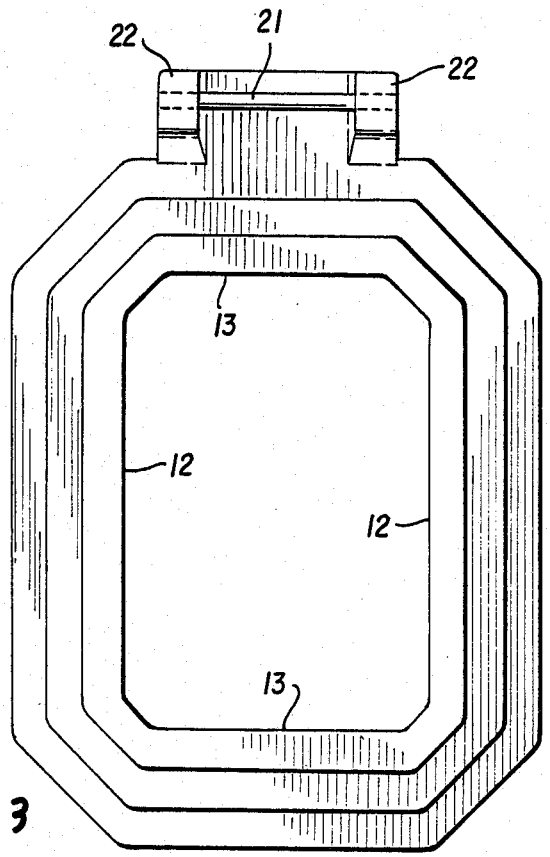
FIG. 3 is an enlarged front elevational view of the frame of the present invention.

Referring now to the drawings 10 designates generally a molded or cast picture frame to be secured to a permanent grave marker such as a tombstone 11 or crypt wall or grass level placque marker. The picture frame has long and short sides 12, 13 which may be externally tiered as at 14 and internally recessed at 15 to snugly receive an aluminum plate 16 to which is secured a photograph 17 laminated with a light stable abrasion resistant film 18 of a thickness of the order of 0.36 mm to 0.20 mm being resistant to ultra-violet light and of the type manufactured by the Industrial Specialties Division of 3M, St. Paul, Minn. under the product designation Y8671 and Y-8672 and marketed under the Scotch brand mark.

The photograph 17 is a portrait of the deceased and its lamination 18 is fused or adhered to an aluminum plate 16 which is geometrically complemental to the internal rectangular recess 15 of the frame 10. The frame 10 may be of a molded weather resistant plastic or a cast or molded metallic alloy.

The laminated picture 17 and aluminum plate 16 are fused by a neoprene contact adhesive having plasticizer resistance and being an aerosal containing rubber and vinyl of the type marked by the Adhesives, Coatings and Sealers Division of 3M, St.Paul, Minn. under the product designation 3M Rubber-Vinyl Adhesive 80 described in bulletin 78-6900-0482-1 (366.5) DPI.

The picture frame 10, its laminated photograph 17 and aluminum plate 16 are sealed against the permanent grave marker 11 whether it be tombstone, crypt wall or grass level stone, concrete or marble by a silicone rubber caulk 19 of the type manufactured by General Electric and marketed under the designation G.E. Silicone Rubber Caulk, Rubber Adhesive Sealant, Stock No. 112). This is applied on the rear face of the frame against the permanent marker to keep the picture 17 moisture free.

The hinge lid 20 and its mount is optional and when employed is mounted on a shaft 21 journalled in bearing ears 22 which permits raising of the lid 20 to view the portrait picture 17 and when seated will protect the photograph 17 from deterioration by attack from the suns ultra-violet rays.

The frame 10 is mechanically secured to the permanent grave marker by screws 23 set into the frame from the rear and the screws are then cemented at 24 into openings drilled into the face of the permanent marker so that vandals cannot remove the frame and picture from the marker with screwdrivers or wrenches. Once set in place the frame cannot be removed without totally destroying it. Thus a portrait photograph 17 is sealed in a non removable frame 10 protecting it from the elements as well as vandals.

What I claim is:

1. For use with a permanent grave marker, a photograph laminated front and rear with a light stable abrasion resistant film of a transparent abrasion-resistant polyurethane film precoated with a long-aging solvent pressure sensitive acrylic adhesive, an aluminum backing plate for said photograph, said laminated picture and said aluminum plate being fused by a neoprene contact adhesive having plasterizer resistance and containing rubber and vinyl, a molded picture frame having a flat back and a tiered recessed opening complemental to said photograph, and said aluminum backing plate being complemental to said recessed opening in the back of said picture frame and being fused to said laminated photograph by said rubber-vinyl adhesive, means sealing the back of said picture frame and aluminum plate flush to said permanent grave marker with said picture exposed forwardly of said marker in place in said frame with a silicone rubber adhesive sealant rubber caulk anchoring means having a rubber adhesive sealant for said frame and picture entering the rear of said picture frame and covering the entire rear surface of the picture frame and backing plate flush therewith in a water sealed condition, a hinged gravity closing cover connected to said frame to selectively cover the laminated picture to shield it from ultra-violet light when not being viewed by an observer, and the rear of said frame spaced from the sealed recessed area having a plurality of openings spaced from the picture area, and mechanical attaching means for securing said frame to said grave marker.

* * * * *